US010563350B2

(12) United States Patent
Kirth et al.

(10) Patent No.: US 10,563,350 B2
(45) Date of Patent: Feb. 18, 2020

(54) ROPE ASSEMBLY

(71) Applicant: TUEFELBERGER FIBER ROPE GMBH, Wels (AT)

(72) Inventors: Rudolf Kirth, Vöcklabruck (AT); Erich Rührnössl, Haid (AT); Susanna Schiemer, Linz (AT); Björn Ernst, Linz (AT)

(73) Assignee: TEUFELBERGER FIBER ROPE GMBH, Wels (AT)

( * ) Notice: Subject to any disclaimer, the term of this patent is extended or adjusted under 35 U.S.C. 154(b) by 176 days.

(21) Appl. No.: 15/115,336

(22) PCT Filed: Jan. 15, 2015

(86) PCT No.: PCT/EP2015/050652
§ 371 (c)(1),
(2) Date: Jul. 29, 2016

(87) PCT Pub. No.: WO2015/113823
PCT Pub. Date: Aug. 6, 2015

(65) Prior Publication Data

US 2017/0002513 A1 Jan. 5, 2017

(30) Foreign Application Priority Data

Jan. 30, 2014 (AT) ..... A 50061/2004

(51) Int. Cl.
*D07B 1/16* (2006.01)
*D07B 1/18* (2006.01)
(Continued)

(52) U.S. Cl.
CPC ..... *D07B 1/162* (2013.01); *B66B 7/062* (2013.01); *D07B 1/18* (2013.01); *D07B 1/22* (2013.01);
(Continued)

(58) Field of Classification Search
CPC .. D07B 1/162; D07B 1/18; D07B 1/22; B66C 1/12
See application file for complete search history.

(56) References Cited

U.S. PATENT DOCUMENTS 3,718,945 A * 3/1973 Brindejonc de Treglode ..... B29C 47/027 24/370
4,350,380 A * 9/1982 Williams ..... B66C 1/18 294/74
(Continued)

FOREIGN PATENT DOCUMENTS

DE 2348713 B1 12/1974
DE 20314422 U1 12/2003
(Continued)

OTHER PUBLICATIONS https://en.wikipedia.org/wiki/Rope (accessed Feb. 27, 2019); referenced by Applicant on Nov. 2, 2018.*
(Continued)

*Primary Examiner* — Shaun R Hurley
(74) *Attorney, Agent, or Firm* — Workman Nydegger

(57) ABSTRACT

The present invention relates to a rope assembly (1) consisting of at least one rope (2) that is made of textile fibre material and is folded back to form two substantially parallel rope portions (2', 2"), wherein load distribution between the two rope portions is enabled and the rope portions are surrounded by a common sleeve (4). The rope assembly according to the invention is particularly suitable as a winch rope or as a rope for drive pulley drives, e.g., as a lift cable, in Koepe hoists and in capstans.

18 Claims, 3 Drawing Sheets

(51) Int. Cl.
*D07B 1/22* (2006.01)
*B66B 7/06* (2006.01)

(52) U.S. Cl.
CPC ..... *D07B 2201/1008* (2013.01); *D07B 2201/209* (2013.01); *D07B 2201/2085* (2013.01); *D07B 2201/2087* (2013.01); *D07B 2201/2091* (2013.01); *D07B 2401/2005* (2013.01); *D07B 2401/2015* (2013.01); *D07B 2401/2055* (2013.01); *D07B 2501/2007* (2013.01)

(56) References Cited

U.S. PATENT DOCUMENTS 4,421,352 A * 12/1983 Raue ..... B65D 63/10 294/74
4,850,629 A 7/1989 St. Germain
5,518,814 A * 5/1996 Bonigk ..... D02G 3/045 428/198
5,651,572 A * 7/1997 St. Germain ..... B66C 1/12 294/74
5,727,833 A * 3/1998 Coe ..... B66C 1/12 294/74
7,637,549 B2 * 12/2009 Hess ..... B66C 1/12 294/74
7,661,737 B2 * 2/2010 St. Germain ..... B66C 1/12 294/74
7,669,904 B1 * 3/2010 Carmichael ..... B66C 1/12 294/74
7,681,934 B2 * 3/2010 Harada ..... B66C 1/12 294/74
9,003,757 B2 * 4/2015 Mozsgai ..... B66C 1/12 57/201
2005/0062303 A1 * 3/2005 Hess ..... B66C 1/18 294/74
2007/0111588 A1 5/2007 Weinberger
2008/0061572 A1 * 3/2008 Harada ..... B66C 1/12 294/74
2009/0078922 A1 * 3/2009 Kempf ..... D07B 1/025 254/266
2011/0000746 A1 * 1/2011 Pelto-Huikko ..... B66B 7/062 187/254
2011/0272956 A1 * 11/2011 Bae ..... B66C 1/12 294/74

FOREIGN PATENT DOCUMENTS

DE 102009005093 A1 9/2009
DE 102008026731 A1 12/2009
GB 2050998 A 1/1981

OTHER PUBLICATIONS

International Preliminary Report on Patentability cited in PCT Application No. PCT/EP2015/050652 dated Aug. 2, 2016.
Written Opinion cited in PCT Application No. PCT/EP2015/050652 dated Aug. 6, 2015.

* cited by examiner

ROPE ASSEMBLY

The present invention relates to a rope assembly which is usable in particular as a winch rope or as a rope for drive pulley drives.

Ropes made of a textile fibre material which may be used as winch ropes are known, for example, from EP 1 061 172 A. The advantage of such ropes (which are composed particularly of high-strength synthetic fibres) over conventional steel ropes consists in particular in their lower weight.

The problems associated with using in particular ropes made of a textile fibre material which have to run over rope sheaves (WO 2011/121272 A1 is to be mentioned as a publication relating merely to an example of winches) consist in that the ropes should be as torque-free as possible.

Those problems are solved in EP 1 061 172 A by using twisted ropes in that two separate ropes each with a different direction of rotation (S and Z, respectively) are arranged next to each other and are fastened by means of a joint rope sheath functioning as a torque support.

A similar solution using steel ropes has already been suggested in DE 2 114 278 A1.

The drawback of the solution suggested in EP 1 061 172 A is that the case may occur that one of the ropes separated from each other carries more load than the other one. This entails the risk of overloading the rope or of the rope failing, respectively.

A further problem consists in how such a "double rope" can be tethered. Frequently, clamps are used for tethering such ropes. However, this is inappropriate for textile ropes, in particular if high-strength fibre materials sensitive to lateral pressure are used which have less transverse compressive strength in comparison to steel wires.

It is the object of the present invention to provide a product made of a textile fibre material which is particularly suitable as a rope for winch applications or drive pulley drives and avoids the above-described problems.

According to the invention, said object is achieved by a rope assembly consisting of at least one rope that is made of textile fibre material and is folded back to form two substantially parallel rope portions, wherein load distribution between the two rope portions is enabled and the rope portions are surrounded by a common sleeve.

SHORT DESCRIPTION OF THE FIGURES

Figure 1:
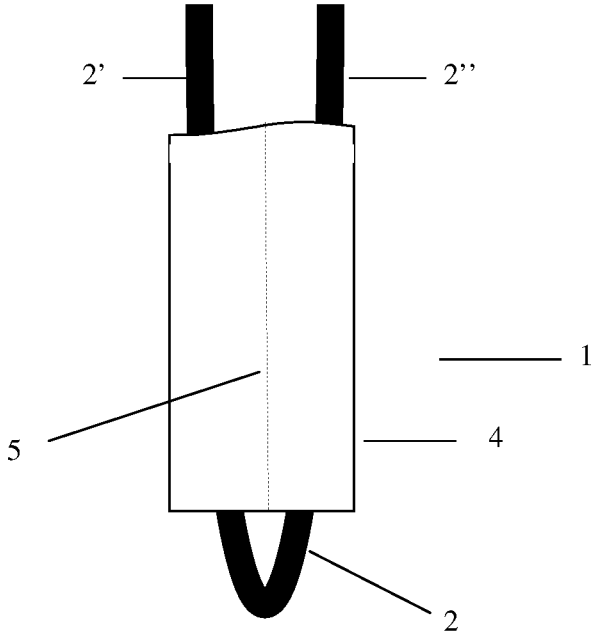
FIG. 1 shows a schematic top view of an embodiment of the rope assembly according to the invention.

According to the present invention, instead of two separate ropes being connected to each other by means of a sleeve functioning as a torque support, rather a single rope is folded back by 180° (for example, in the centre) so that the two resulting rope portions will lie next to each other essentially in parallel.

According to the invention, load distribution is enabled between the rope portions which have been formed, for example, in that they are displaceable against each other.

The rope portions are surrounded by a common sleeve which serves for stabilizing the rope portions and thus the rope assembly. However, the sleeve is configured such that the load distribution between the two ropes is not impeded.

By folding back the rope, a loop is formed which may be used in a simple manner as an end connection.

A preferred embodiment of the rope assembly according to the invention is characterized in that the rope assembly contains two or more ropes which have been folded back.

Thus, two or more ropes are folded back according to the invention, and the resulting rope portions are encased by a common sleeve.

This embodiment is advantageous since several thin strands, via positive locking, result in better adhesion of the rope assembly on the pulley. In addition, the amount of material (and hence the breaking force of the entire rope assembly) is distributed between several ropes so that the rope diameter will become smaller, i.e., the rope assembly will assume an increasingly "flat" shape.

In particular if twisted ropes are used, an embodiment consisting of at least two ropes that have been folded back is advantageous, since a single rope which has been folded back might induce a torque, depending on its precise structure. If a second twisted rope having an opposite direction of rotation is used, said problem can be avoided.

Altogether, the combination of ropes used must be configured such that, during operation, no twisting will occur in the resulting rope assembly, i.e., it will be essentially torque-neutral.

In the embodiment according to the invention made of two or more ropes which have been folded back, it is not necessary that the two rope portions of a rope which emerge during the folding-back process end up lying directly next to each other. An arrangement in which the resulting rope portions of the different ropes run mixed with each other may also be provided, provided that, altogether, all rope portions extend essentially in parallel.

In a preferred embodiment, all resulting rope portions lie coplanar so that the rope assembly assumes a band-like shape.

However, arrangements are also possible in which individual rope portions extend, for example, obliquely offset to other rope portions.

In this connection, it is important for all applications that the rope assembly according to the invention is constructed such that it is not twistable around itself during use (e.g., on return pulleys, deflection pulleys, drive pulleys, capstans, gypsy winches, storage drums and the like), based on the external shape resulting from the arrangement of the rope portions, but, if applicable, also as a result of a corresponding weight distribution which arises if ropes of different weights are used.

In a further preferred embodiment of the invention, at least one of the rope portions extends in a detached part of the sleeve. Said detachment can be produced, for example, by a seam extending between two rope portions. In this connection, it is again important that the load distribution between the rope portions is not impeded. Several detached parts may be provided, which will be explained in further detail below.

In the rope assembly according to the invention, at least one additional strand, e.g., a conductive wire or an optical waveguide, may preferably be carried along.

The ropes usable in the rope assembly according to the invention can be plaited or twisted/laid. As mentioned above, the use of at least two ropes each with a different direction of rotation is preferred if twisted ropes are used.

In case several ropes are used, the ropes may have equal or different diameters. The ropes may consist of equal or different materials. The construction type of the ropes may be equal or different. In that case, it would be conceivable that, at first, one of the ropes takes on the load and the second rope or the further ropes, respectively, (at first) has or have no load-carrying function due to other properties, but is or are present as a redundancy.

However, the resulting rope assembly has to be torque-neutral in each case, and a load distribution must occur within a rope that has been folded back so that both rope portions carry the same load.

High-strength textile fibre materials as well as units produced therefrom such as twines, laces etc., which are known as such to a person skilled in the art, may be used as materials for the ropes to be used.

The sleeve serving for sheathing the rope portions may consist essentially of any material, provided that it does not impede the load distribution between the rope portions. For example, the sleeve may be formed from an extruded plastic sleeve or again from a plaited, woven or knitted fibre material.

The sleeve may surround all rope portions jointly in the fashion of a single tunnel or may be divided into two or more detached parts, i.e., "sub-tunnels", in which the rope portions are guided individually or possibly also partly individually and partly in pairs or at an even higher number.

The sub-tunnels can be produced by sewing. Likewise, the production of a sleeve consisting of several sub-tunnels is possible in the course of a plaiting process, wherein two (or several) plaiting machines operate in parallel side by side and the bobbins are exchanged between the plaiting machines so that two independent plaited sleeves will not be formed, but connections will exist between them.

The rope assembly according to the invention is particularly suitable as a winch rope or as a rope for drive pulley drives, e.g., as a lift cable, in Koepe hoists and in capstans.

In the following, the present invention is illustrated further on the basis of the figures.

FIGS. 1 (top view) and 2 (cross-section) schematically show a preferred embodiment of a rope assembly 1 according to the invention, which is obtained by folding back a rope 2 made of a textile fibre material, which is not specified in further detail herein. As the rope 2 is folded back, two rope portions 2' and 2" are formed. According to the invention, they are surrounded by a common, preferably continuous sleeve 4, e.g., of a textile material, which stabilizes the rope portions 2' and 2", but does not impede the load distribution between the two rope portions so that they are displaceable in particular against each other.

By folding back the rope 2, a loop is created which is suitable in a simple manner as an end connection.

Figure 2:
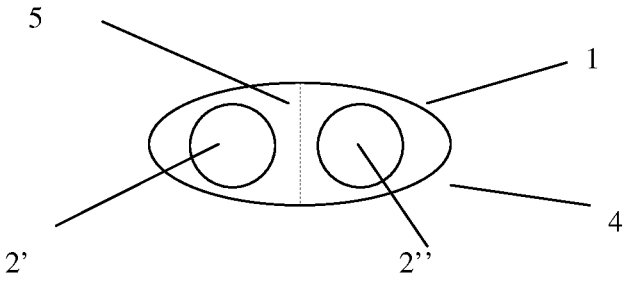
FIG. 2 shows a schematic cross-section of an embodiment of the rope assembly according to the invention.

In the preferred embodiment shown in FIGS. 1 and 2, the sleeve 4 is divided into two parts by a seam 5 so that the two rope portions 2' and 2" run, in each case, in a detached part of the sleeve 4, without, however, the mutual displaceability and hence the load distribution between the rope portions being prevented thereby.

Figure 3:
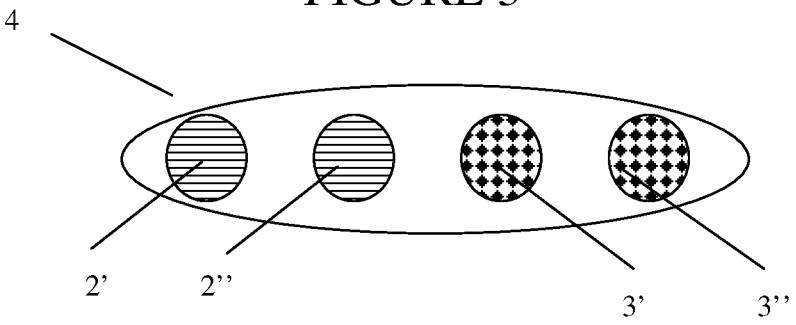
FIGS. 3 to 6 show various embodiments of a rope assembly which is obtained by folding back two ropes.
Figure 4:
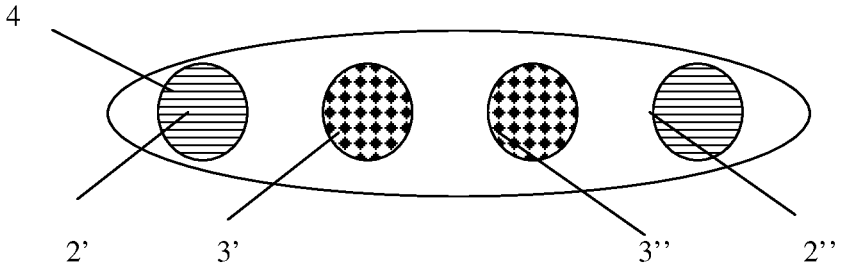
Figure 5:
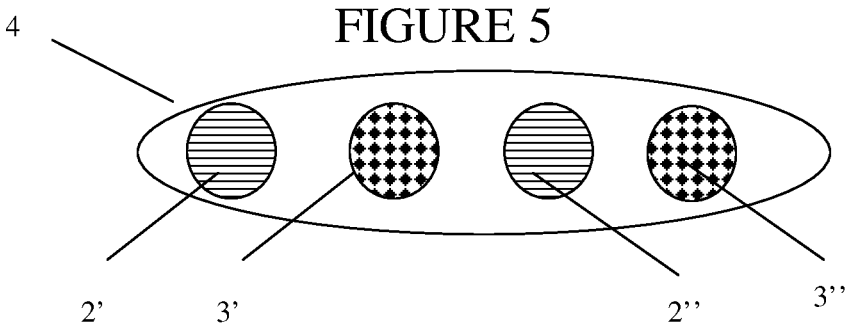

In FIGS. 3 to 6, cross-sections of various embodiments of a rope assembly are illustrated, which is constructed by folding back two ropes, whereby a total of four rope portions 2', 2", 3' and 3" is obtained. As can be seen in FIGS. 3 to 5, the rope portions 2', 2" as well as 3', 3", which are thereby obtained from the two ropes, can be provided in different arrangements.

For example, the rope portions obtained by folding back one rope may (FIG. 3), in each case, lie directly next to each other, or, however, may also be provided (FIGS. 4 and 5) mixed with the rope portions obtained from the other rope.

In the embodiments of FIGS. 3 to 5, the obtained rope portions 2', 2", 3' and 3" each lie coplanar and are stabilized in this form by the respective common sleeve 4. This leads to a flat, band-like configuration of the resulting rope assembly.

Figure 6:
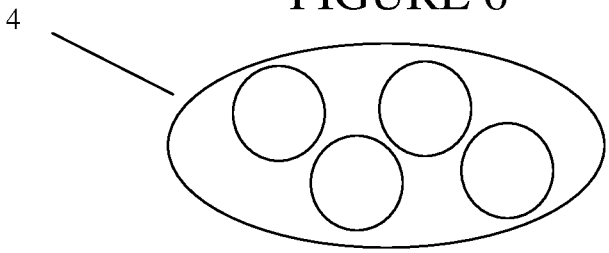

However, as illustrated in FIG. 6, other arrangements of the obtained rope portions, for example, obliquely offset to each other, are possible as well. In the embodiment of FIG. 6, the arrangement of the four obtained rope portions relative to each other (that is, directly beside the second rope portion obtained from the same rope or mixed with rope portions from the other rope) may also be constructed in any desired fashion, for which reason the obtained rope portions are not designated any further in FIG. 6.

Figure 7:
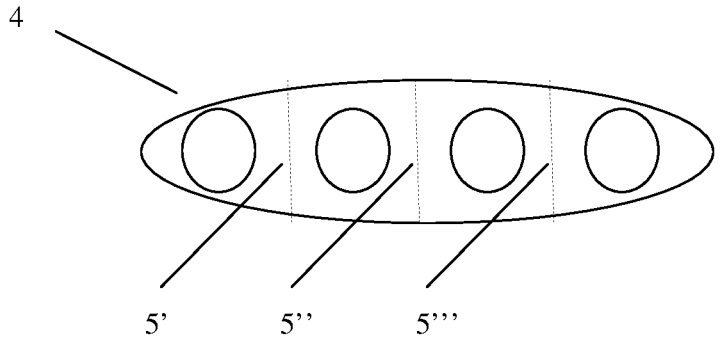
FIGS. 7 and 8 show embodiments of a rope assembly according to the invention, with several parts of the sleeve being detached.
Figure 8:
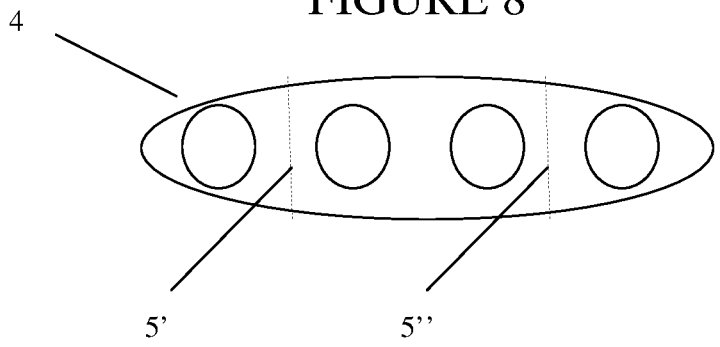

Also in the embodiments of the rope assembly according to the invention which are obtained from two or more ropes, detached parts of the sleeve may be provided, as illustrated in FIGS. 7 and 8.

In the embodiment according to FIG. 7, four detached parts of the sleeve 4 are obtained in total by three seams 5', 5" and 5''', always with one rope portion (herein not indicated any further) running therein.

According to FIG. 8, three detached parts of the sleeve 4 are obtained by two seams 5' and 5", with one rope portion each running in the respective outer parts and two rope portions being arranged in the central part.

Of course, various further possibilities of separations and arrrangements of rope portions are feasible herein, which will be readily evident to a person skilled in the art.

It applies to all illustrated embodiments that a load distribution is possible between the obtained rope portions of a rope, in particular in that they are displaceable against each other. Of course, this does not rule out that the rope assembly optionally comprises additional strands or also additional rope portions obtained by folding back a rope without the possibility of a load distribution.

The invention claimed is:

1. A rope assembly suitable for winch applications or drive pulley drives, comprising at least one rope that is made of textile fibre material and that is folded back to form two adjacent rope portions, wherein the adjacent rope portions are surrounded by a common sleeve that permits the adjacent rope portions to be displaceable against each other so as to equalize load distribution between the adjacent rope portions, wherein the common sleeve is disposed between a first end of the rope assembly, where the adjacent rope portions are folded back, and a second end of the rope assembly having a plurality of rope ends.

2. A rope assembly according to claim 1, wherein the rope assembly contains two or more ropes which have been folded back.

3. A rope assembly according to claim 1, wherein at least one of the rope portions runs in a detached part of the common sleeve.

4. A rope assembly according to claim 1, wherein at least one additional strand is carried along in the rope assembly.

5. A rope assembly according to claim 2, wherein the rope portions are coplanar so that the rope assembly assumes a band-like shape.

6. A rope assembly according to claim 2, wherein the rope assembly is not twistable around itself during use.

7. A rope assembly according to claim 4, wherein at least one additional strand comprises a conductive wire.

8. A rope assembly according to claim 4, wherein at least one additional strand comprises an optical waveguide.

9. A method of using a rope assembly according to claim 1, wherein the rope assembly is a winch rope.

10. A method of using a rope assembly according to claim 1, wherein the rope assembly is a rope for a drive pulley drive.

11. A method of using a rope assembly according to claim 10, wherein the rope assembly is a lift cable.

12. A method of using a rope assembly according to claim 10, wherein the rope assembly forms part of a Koepe hoist.

13. A method of using a rope assembly according to claim 10, wherein the rope assembly forms part of a capstan.

14. A rope assembly according to claim 1, wherein the at least one rope of the rope assembly is plaited or twisted.

15. A rope assembly suitable for winch applications or drive pulley drives, comprising at least two ropes that are made of textile fibre material and that are folded back to form at least four adjacent rope portions, wherein the adjacent rope portions are surrounded by a common sleeve that permits each of the adjacent rope portions to be displaceable against each other so as to equalize load distribution between the adjacent rope portions, wherein the common sleeve is disposed between a first end of the rope assembly, where the adjacent rope portions are folded back, and a second end of the rope assembly having a plurality of rope ends.

16. A rope assembly according to claim 15, wherein the at least two ropes of the rope assembly are each plaited or twisted.

17. A rope assembly, comprising at least one plaited or twisted rope that is made of textile fibre material and that is folded back to form two adjacent rope portions, wherein the adjacent rope portions are surrounded by a common sleeve that permits the adjacent rope portions to be displaceable against each other so as to equalize load distribution between the adjacent rope portions, wherein the common sleeve is disposed between a first end of the rope assembly, where the two adjacent rope portions are folded back, and a second end of the rope assembly having two rope ends.

18. A rope assembly according to claim 17, wherein the common sleeve is detached from the two adjacent rope portions so that at least one rope portion is displaceable against the common sleeve.

* * * * *